US005237790A

United States Patent [19]

Smalley

[11] Patent Number: 5,237,790

[45] Date of Patent: Aug. 24, 1993

[54] STRUCTURE FABRICATED OF PLASTIC COMPONENTS

[76] Inventor: Art Smalley, 18 Splitrock, The Woodlands, Tex. 77381

[21] Appl. No.: 555,310

[22] Filed: Jul. 20, 1990

Related U.S. Application Data

[63] Continuation-in-part of Ser. No. 330,130, Apr. 3, 1989, abandoned.

[51] Int. Cl.[5] ..... E04B 1/00

[52] U.S. Cl. ..... 52/282.3; 52/546

[58] Field of Search ..... 52/282, 284, 285, 546

[56] References Cited

U.S. PATENT DOCUMENTS 3,783,563 10/1974 Moore .
3,828,496 8/1974 Testaguzza et al. .
4,236,363 12/1980 Vinther et al. ..... 52/285
4,599,963 7/1986 Payne ..... 52/282 X
4,621,467 11/1986 Golden .
5,052,741 10/1991 Brown et al. ..... 52/282 X

FOREIGN PATENT DOCUMENTS 1311988 11/1962 France ..... 52/282

*Primary Examiner*—Carl D. Friedman
*Assistant Examiner*—Lan M. Mai
*Attorney, Agent, or Firm*—James L. Jackson

[57] ABSTRACT

In a building system, extruded panel components are joined together to form the building structure. Connector members join the panel components together to form a completed structure. The connector members provide for releasable interlocking assembly of structural members thereto for enhancement of the structural integrity of the building structure. The structural members may also be integral with the connector members if desired. The panel components are light weight corrugated polymer sheets including integral snap-in connectors along the longitudinal edges thereof and snap-in connectors along the top and bottom edges thereof.

27 Claims, 7 Drawing Sheets

FIG. 3
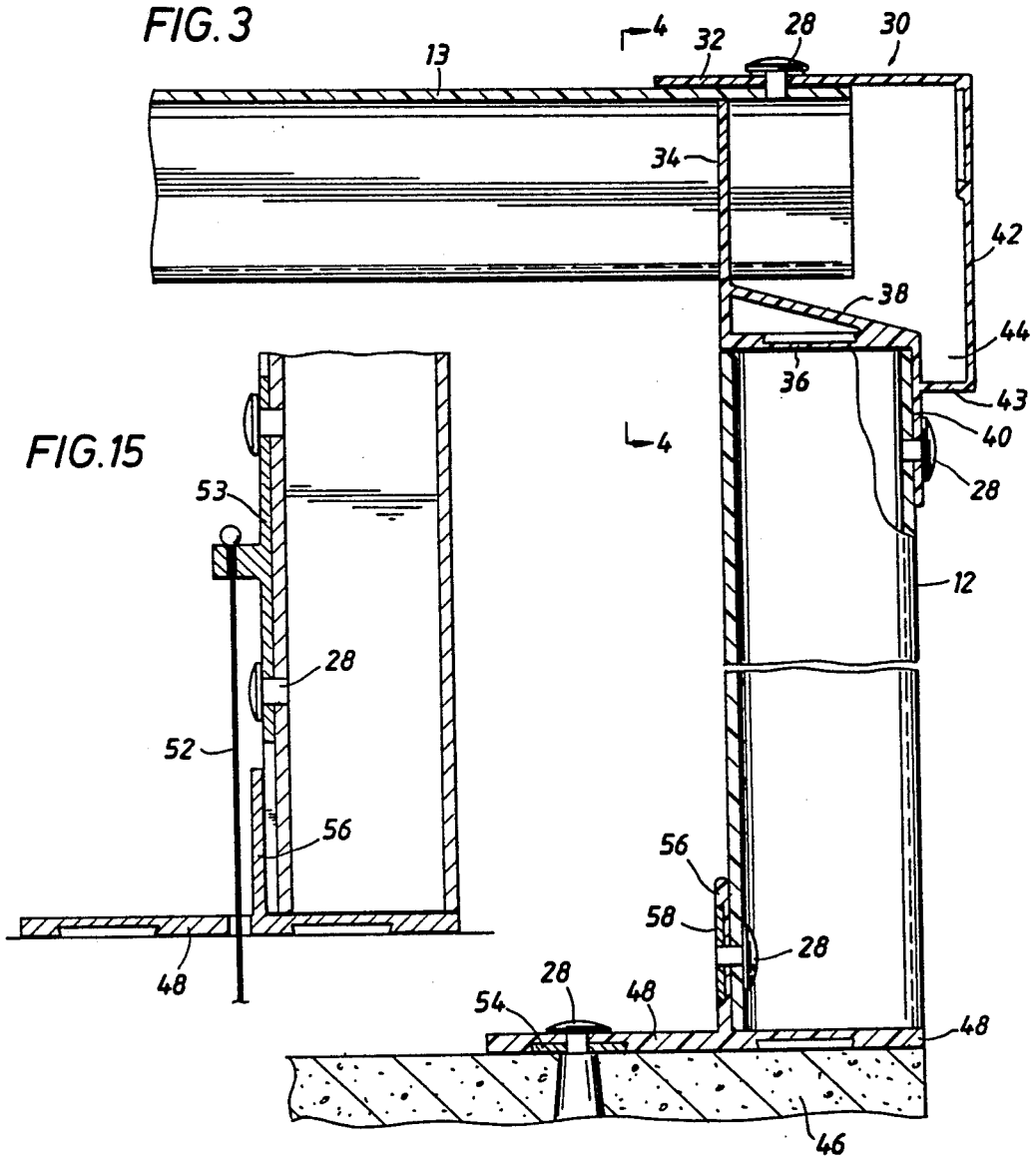
FIG. 15
FIG. 4
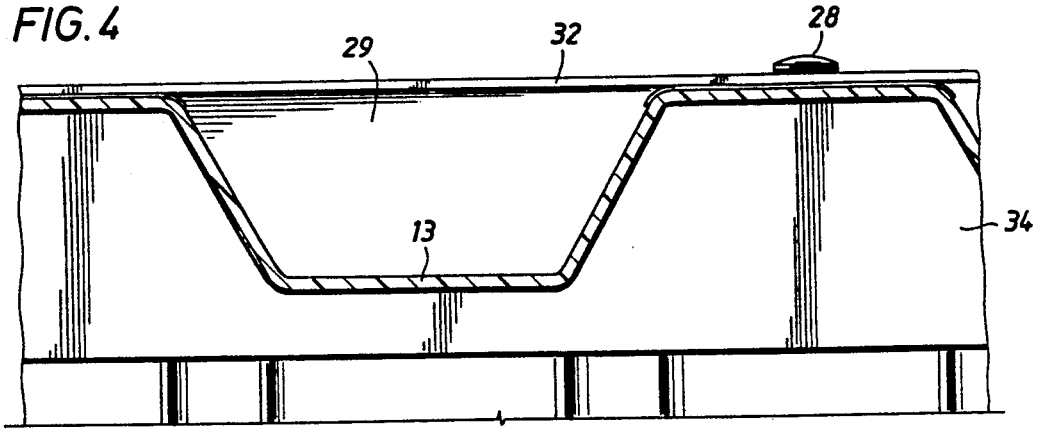

FIG. 16
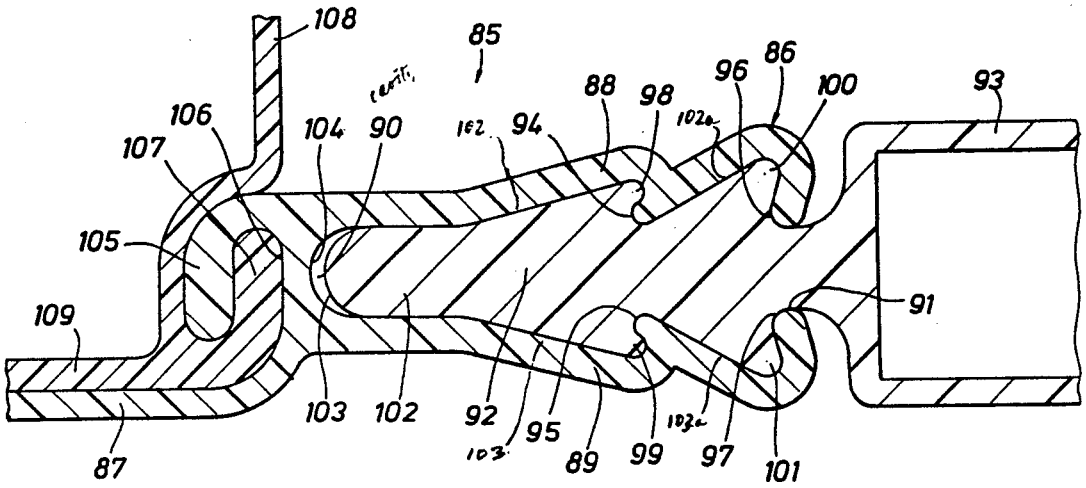
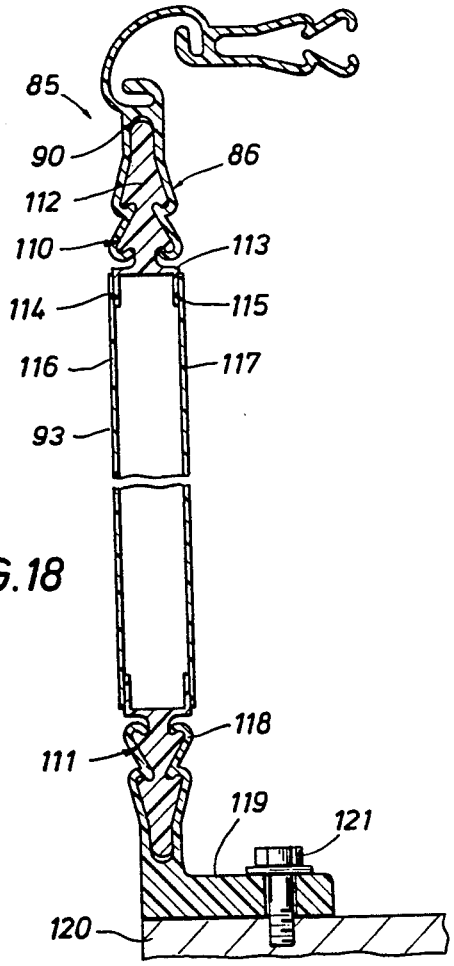
FIG. 18
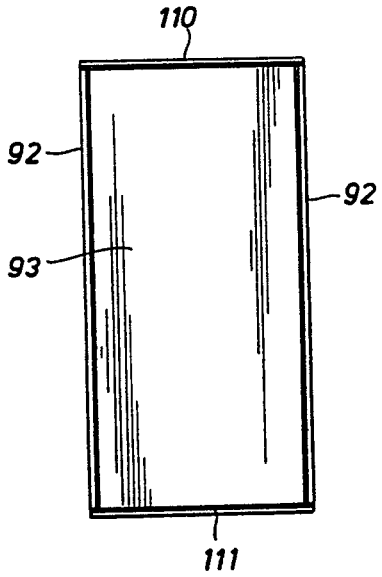
FIG. 17

STRUCTURE FABRICATED OF PLASTIC COMPONENTS

This is a Continuation-In-Part of U.S. patent application Ser. No. 07/330,130 filed on Apr. 3, 1989, and titled STRUCTURE FABRICATED OF PLASTIC COMPONENTS, now abandoned.

BACKGROUND OF THE DISCLOSURE

The present invention is directed to a building structure particularly to a structure utilizing plastic components to form the structural elements of the structure.

There has long been a need for a low maintenance, easy to assemble and expandable storage building. In the utilization of plastic, structures can be manufactured that will not rust and will not rot. Aside from storage structures, when clear plastic is used in the manufacturing of the components a greenhouse can be made.

Attempts have been made to provide inexpensive building structures. U.S. Pat. No. 3,783,563 discloses a building structure employing modular components formed of molded plastic material, reinforced with glass fibers. The panels may be used to form roofs, ceilings, side walls and floors. The panels include passage ways for electrical wiring, heating, water and waste material.

U.S. Pat. No. 3,828,496 discloses a building structure including a prefabricated base, wall units and roof units. The wall and roof units include at least one panel with a hollow portion therein. The wall and roof units cooperate so that when they are placed in position, the hollow portions thereof are in communication. Concrete is poured through the openings to provide a unitary structure.

U.S. Pat. No. 4,621,467 discloses a building structure that is formed out of extruded, plastic components. The components snap together but may also be assembled with adhesives or glues. The building structure is formed with vertical walled, elongated triacontahedral structures clustered together to form a building.

The above noted patents, however, do not disclose a building system solely utilizing plastic components which are joined together to form a structure. It is, therefore, an object of the present disclosure to provide a building system utilizing extruded, molded plastic components to form the building structure of the invention. The components of the building system of the invention are delivered to the building site for assembly of the building structure.

SUMMARY OF THE INVENTION

The present invention comprises a structure fabricated of plastic components. The components include snap-in type connectors for joining the components together to form a completed structure. The panel components may define a corrugated profile providing rigidity and strength to the structure or may form any other suitable configuration.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 3 is a partial, enlarged sectional view taken along line 3—3 of FIG. 2;

FIG. 4 is a partial, sectional view taken along line 4—4 of FIG. 3;

FIG. 15 is a partial, sectional view showing the structure of the invention anchored to the ground or a slab.

FIG. 16 is a fragmentary sectional view of a panel and panel connector showing the structural configuration of a preferred embodiment thereof in detail.

FIG. 17 is an elevational view of a panel structure showing the panel to have side connectors and connectors at the top and bottom thereof.

FIG. 18 is a partial sectional view illustrating a wall panel and showing the top and bottom connector elements thereof in detail.

DETAILED DESCRIPTION OF THE PREFERRED EMBODIMENT

Figure 1:
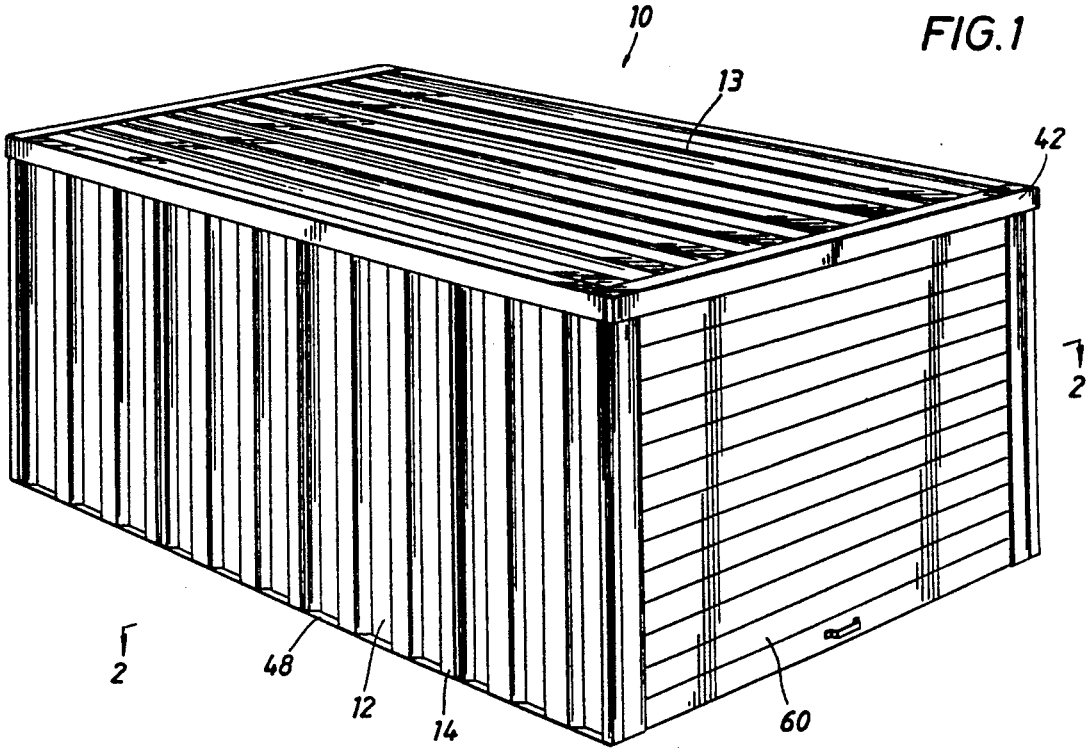
FIG. 1 is a perspective view illustrating a representative structure capable of assembly from the components of the present invention.

Referring first to FIG. 1, a representative structure fabricated of plastic components is generally identified by the reference numeral 10. The walls and roof of the building 10 are formed with the building components of the invention as will be more fully described hereinafter. Windows are not shown in the building 10 of FIG. 1, however, it is understood that windows may be incorporated in the building structure 10 if desired.

The building 10 is contemplated to be relatively simple in design so that it may be provided to a consumer in kit form for easy assembly. The building 10 shown in FIG. 1 is substantially rectangular in shape having three walls and a roof to form an enclosed storage area such as a tool shed or the like. The shape of the building 10 however is not material. It may be of any desired shape. For example, the building 10 may include a gabled roof or any other roof design formed with the components of the invention. The open end of the building 10 may be closed by an articulated door similar to a garage door or may define doors and windows of other design.

Figure 2:
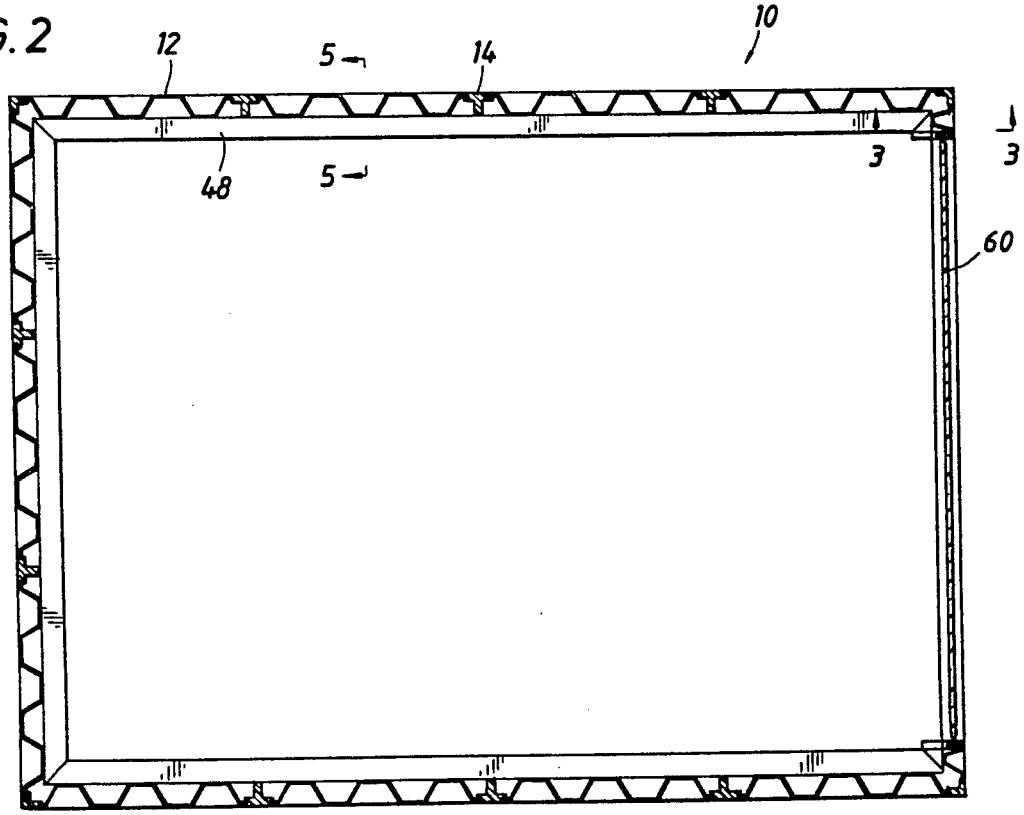
FIG. 2 is a sectional view of the structure of the invention taken along line 2—2 of FIG. 1.
Figure 5:
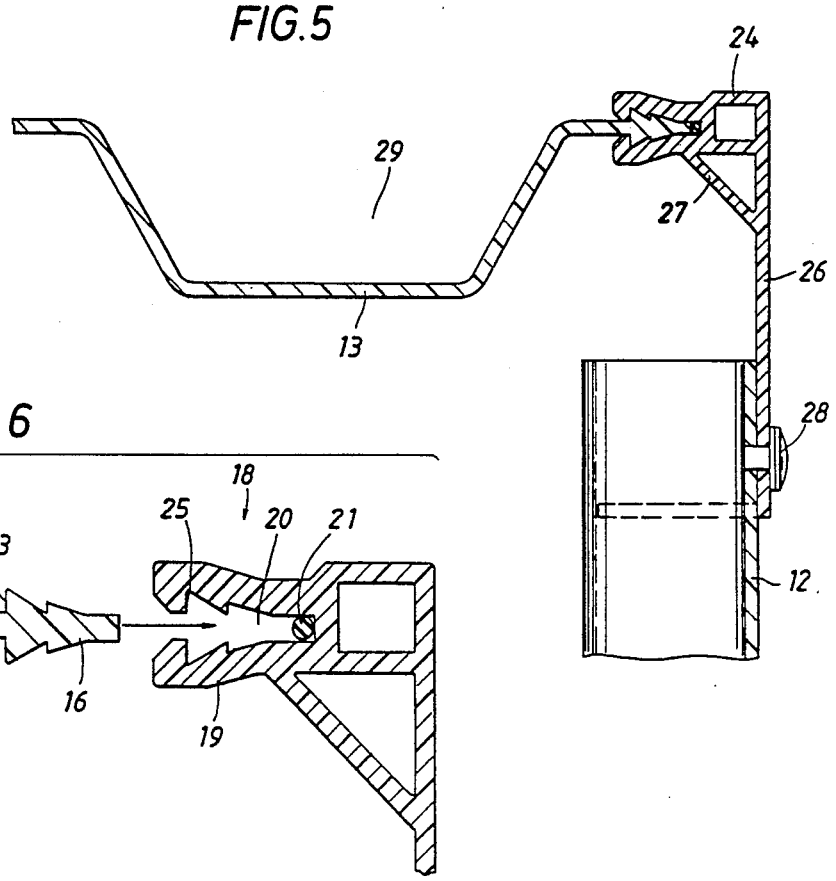
FIG. 5 is a partial, sectional view taken along line 5—5 of FIG. 2.
Figure 6:
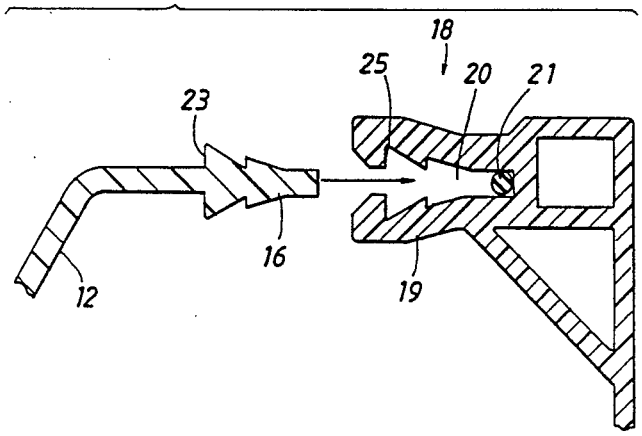
FIG. 6 is a partial, sectional view showing the snap-in connector structure of the invention.
Figure 7:
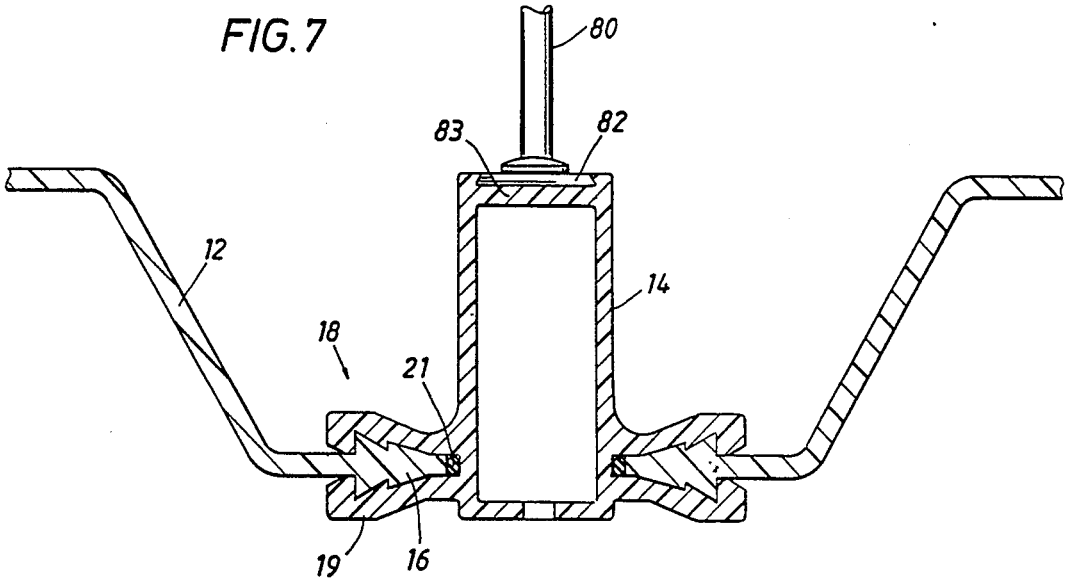
FIG. 7 is a partial, sectional view showing two panels of the building system of the invention connected to a panel connector.

Referring now jointly to FIGS. 1 and 2, the walls and roof of the building 10 are formed by a series of panels 12 which are joined together by panel connectors 14 which may also form a structural member for enhancement of the structural integrity of the joined panels and panel connectors. The panels 12 are fabricated to a standard width and height. A plurality of panels 12 may be joined end to end to form the desired length of a wall of the building 10. Assembly of the building 10 is very simple and does not require the use of special tools. Each panel 12 is provided with a spear-like end connector 16 which extends the full length of the panel 12, as best shown in FIGS. 5–7. As shown in FIG. 7 the panel connector 14 is shown to include a generally rectangular section which functions as a structural member which, for the walls of a building structure will be oriented in generally vertical manner. It should be born in mind that the panel connector may be of any desired dimension and of any desired configuration for appropriate enhancement of the structural integrity of the building. Each panel connector 14 includes at least one receptacle connector 18 integrally formed therewith and defining a profiled cavity 20 for receiving the end connector 16 of a panel 12. The receptacle connector 18 extends the full length of the panel connector 14 and is formed by a pair of opposed flexible arms 19. The arms 19 of the receptacle 18 present opposed serrated internal surfaces for engagement and locking with the similarly profiled head of the connector 16. The connector 16 is integrally formed with the panel 12. This is accomplished through an extrusion mold process or the like.

Referring again to FIG. 6 it will be observed that a resilient seal 21 extends along the inner back shoulder surface of the cavity 20. The seal 21 is engaged and compressed by the tip of the connector 16 upon insertion of the connector 16 into the cavity 20. The head of the connector 16 is advanced into the cavity 20 until the arms 19 snap or lock about a back surface 23 of the connector 16 as best shown in FIG. 5. In the locked position, the compressed seal 21 pushes against the head of the connector 16 to maintain a surface to surface seal along the back surface 23 of the connector 16 and a cooperating surface 25 formed on the arms 19 of the connector 18. This seal also provides waterproofing for the walls and roof. Disengagement of a panel 12 from a connector 14 is accomplished by separating the arms 19 of the connector 18 permitting the connector 16 to be withdrawn from the cavity 20. As will be explained hereinbelow in the discussion of FIG. 16 the secure nature of the joint established by the female receptacle 19 forming the cavity 20 and the male connector 16 will require a special tool to simultaneously pry the arms of the female connector apart to thus achieve release of the male connector.

The building 10 of the invention is provided with three basic panel connectors. The panel connector 14 shown in FIG. 7 is provided with a pair of oppositely facing receptacle connectors 18 for connecting panels 12 end to end to form the walls and roof of the building 10. The panel connector 14 includes a substantially rectangular body which in FIG. 7 is shown as a structural member which is hollow to reduce the weight of the connector 14. If desired however the panel connector 14 may be fabricated out of solid plastic material or t he hollow void may be filled with expandable foam to provide additional rigidity. As mentioned above, the panel connector 14 may be of any other desired configuration without departing from the spirit and scope of this invention.

Figure 8:
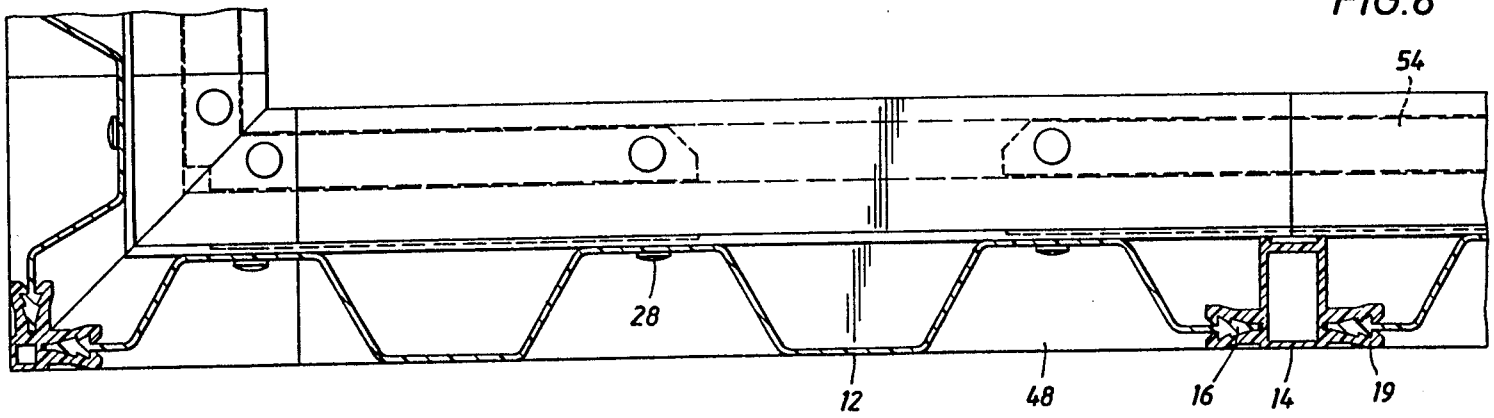
FIG. 8 is a partial, sectional top view showing a wall section of the structure of the invention.

A corner connector 22 is shown in FIG. 8. The receptacle connectors of the corner connector 22 are oriented at a right angle to each other for connecting the panels 12 to form a corner of the building 10.

In FIG. 5, a roof connector 24 is shown. The roof connector 24 includes a receptacle connector as previously described having a flange plate 26 extending downwardly from the back side thereof. An angularly extending brace member 29 is provided between the flange plate 26 and receptacle connector body. The roof connector 24 joins the roof panels 13 to the wall panels 12. When the roof panels 13 are completely assembled and placed above the wall panels 12, the flange plate 26 of the roof connector 24 overlaps the wall panels 12. Holes are provided along the flange plate 26 which are aligned with holes formed in the wall panels 12 for receiving a push pin 28 or nut and bolt therethrough. The holes in the flange plate 26 and wall panels 12 are pre-drilled at predetermined locations so that when the roof of the building 12 is assembled and secured to the wall panels it is substantially level and square with the walls of the building 10.

The corrugated profile of the roof panels 13 form channels 29 in the roof of the building 10. In the event of rain, the rain water is collected in the channels 29 and directed to either end of the roof and diverted from the roof via end roof connectors 30. The end roof connectors 30, shown in greater detail in FIG. 3, function as gutters for diverting the rain water to a downspout (not shown in the drawings). The end roof connectors 30 generally comprise a rectangular hollow tube. The top surface 32 of the roof connectors 30 extend over the exposed surface of the roof panels 13 and are connected thereto by push pins 28 or nut and bolt. The internal member 34 of the roof connector 30 is die cut to the profile of the corrugated roof panels 13. The inner member 34 thus provides a roof support which is in contact with the inner surface of the roof panel 13 so that the weight of the roof is evenly distributed across the end connectors 30. The bottom member 36 of the roof connector 30 extends across the top of the wall panels 12. The bottom member 36 has a width sufficient to span across the peaks and valleys of the corrugated wall panels 12. An angle connector 38 provides additional support for carrying the load of the roof panels 13. The bottom member 36 terminates at a downwardly extending flange 40 which overextends the wall panels 12. Push pins 28 or nut and bolt connect the end connector 30 to the wall panels 12. The external vertical member 42 completes the substantially tubular shape of the end connector 30. The member 42 terminates at an inwardly extending horizontal member 43 thereby connecting the top member 32 to the flange 40. The member 42 extends slightly below the bottom member 36 so that a gutter 44 is formed for removal of rain water for the roof. The inclined connector 38 aids in diverting rain water into the gutter 44.

Referring now to FIGS. 3 and 8, the base plate of the invention is shown connected to a foundation 46. The foundation may be a concrete slab, wood flooring, dirt floor or other suitable surface. The base plate 48 is mounted to the foundation 46 utilizing any suitable standard fastener. For example, in FIG. 15 an external anchoring mechanism comprising a nylon cord 52 is shown. The cord 52 is connected to the panel connector of the building and extends through the base plate 48 and is connected at the other end to a ground anchor.

Referring now specifically to FIG. 8, it will be observed that the base plate 48 is cut in segments of standard length. The segments of the base plate 48 are positioned end to end and connected by insert connectors 54. The insert connectors 54 slide into a slot formed in the base plate 48 and span between adjacent segments of the base plate 48 and are secured to the base plate segments by push pins 28 or threaded bolt.

Referring again to FIG. 3, the base plate 48 includes an upstanding integral bracket 56 for connection to the lower end of the wall panels 12. The brackets 56 are slotted for receiving bracket inserts 58 for connecting brackets 56 end to end and thereby forming a substantially unitary base plate assembly when all the base plate segments are mounted to the foundation 46. The wall panels 12 are joined to the base plate brackets 56 by push pins 28 or a nut and bolt.

Figure 12:
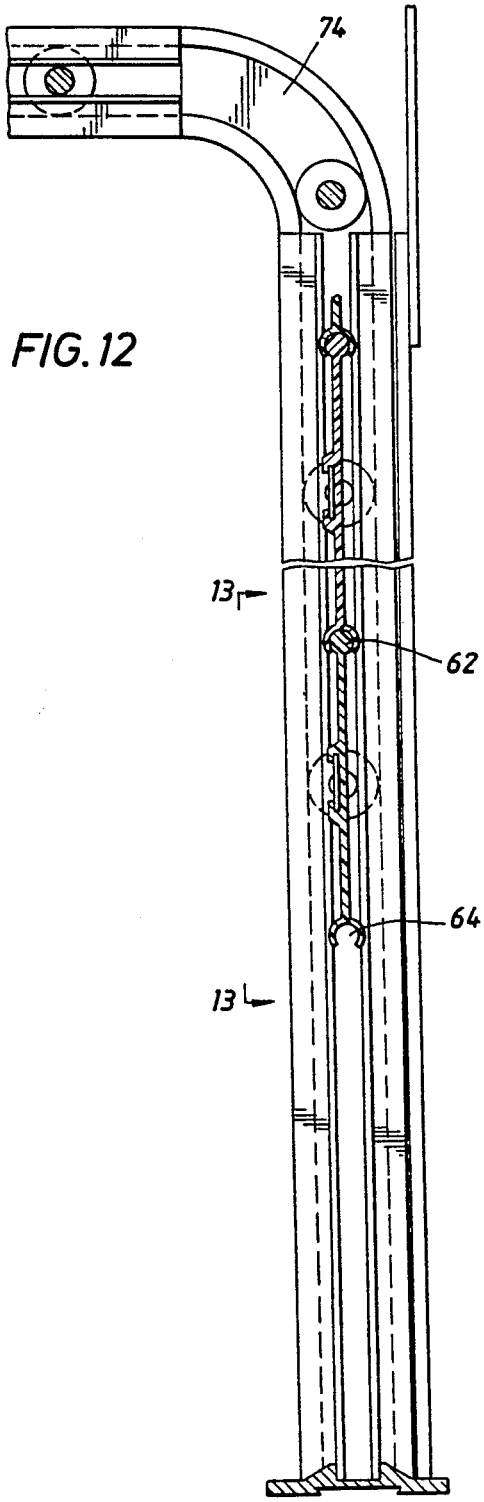
FIG. 12 is a partial, sectional view of the door mechanism of the invention.
Figure 13:
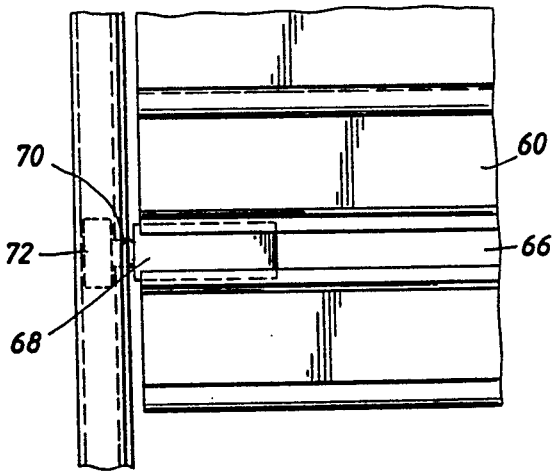
FIG. 13 is a partial, front view of the door mechanism of the invention.

Referring now to FIGS. 12 and 13, a sectional view of the door assembly is shown. The door of the building 10 is formed by a series of interconnected panels 60. The panels 60 are formed of extruded plastic material cut to a suitable length and width. For example, the panels 60 may be 4" to 6" in height and 8' in width providing convenient access to the building 10. The panels 60 include an integral head 62 extending across the top edge thereof. Across the lower edge of the panels 60, a slot 64 is formed for receiving the head 62. The door of the building 10 is formed by sliding the head 62 of one panel 60 into the slot 64 of another panel 60. A number of panels 60 are connected in this manner to form the required height of the fully extended door. The back surface of the panels 60 are provided with a longitudinal slot 66 for receiving a connector 68. The connector 68 includes an integrally formed axle 70 which projects outwardly therefrom. A roller or wheel 72 is journaled about the axle 70. The roller 72 is received within a track 74 mounted to the door opening of the building 10. The assembled door is installed so that the rollers 72 engage the track 74 permitting the door to be raised or lowered in a typical fashion.

Figure 11:
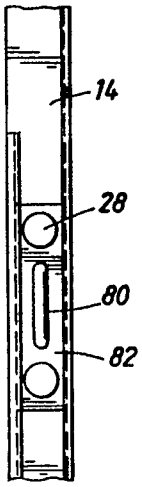
FIG. 11 is a partial, sectional front view of the hook support shown in FIG. 10.
Figure 10:
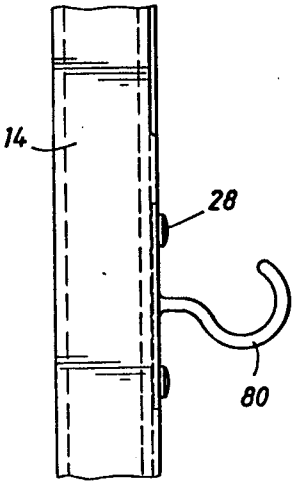
FIG. 10 is a partial, sectional side view of a panel connector of the invention having a hook support mounted thereon.
Figure 9:
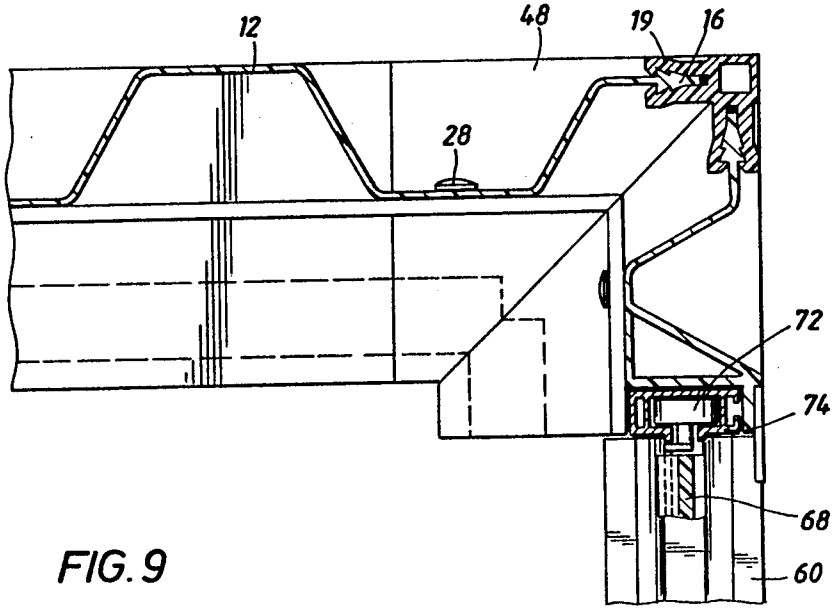
FIG. 9 is a partial, enlarged sectional view of a corner connector of the invention.
Figure 14:
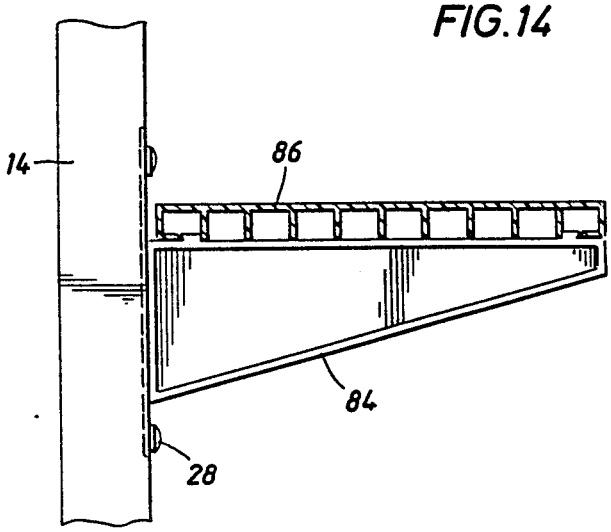
FIG. 14 is a partial, sectional side view of a shelf support mounted to a mid wall connector of the invention.

Referring now to FIGS. 10, 11 and 14, accessories which may be mounted within the building 10 are shown. In FIGS. 10 and 11, a hook 80 is shown mounted to a connector 14. The hook 80 projects outwardly from a base member 82 which is mounted to the connector 14 by push pins 28 or a threaded bolt. The connector 14 includes a longitudinally extending slot formed in the end member 83 of the connector 14 for receiving the base member 82 therein. In FIG. 14, a shelf support 84 is similarly mounted to connectors 14. A series of shelf supports 84 may be mounted to a connector 14 for providing support for a shelf 86 which may be snapped onto the shelf supports 84. Other similar type attachments may be mounted to the connectors 14 of the building 10 as desired to provide additional storage space.

Figure 19:
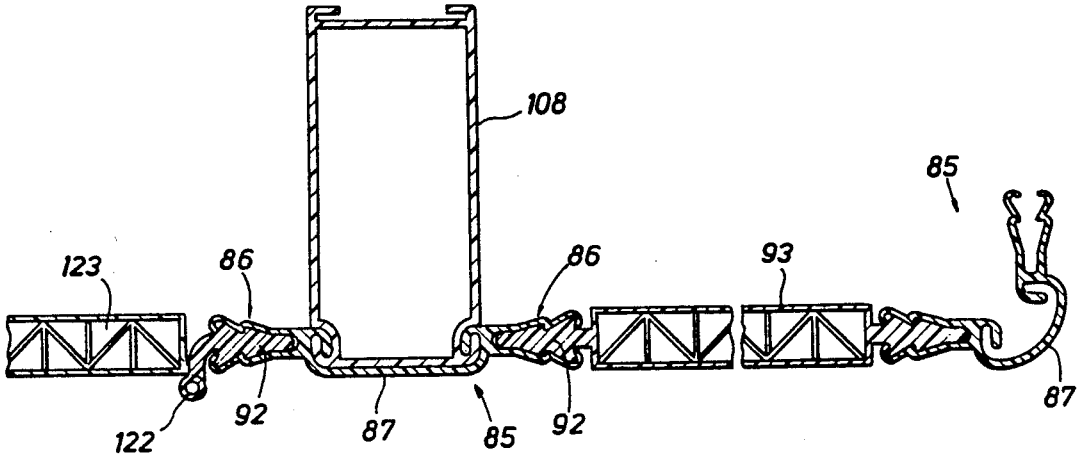
FIG. 19 is a sectional view illustrating a wall panel and a door and a connector by which the same are maintained in assembly and a structural member also in assembly therewith.
Figure 20:
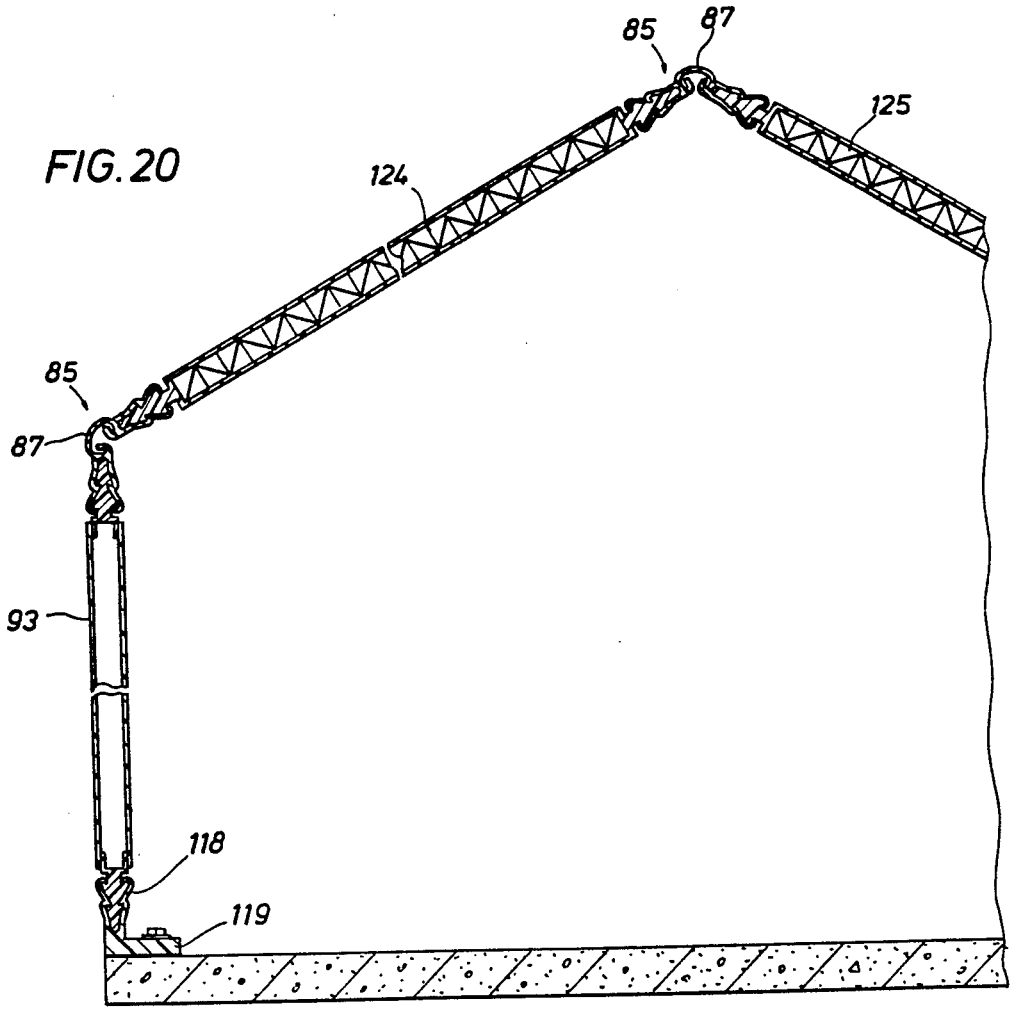
FIG. 20 is a sectional view in plan illustrating wall and roof panels of a building structure being interconnected by the connectors hereof.

Referring now to FIG. 16 a preferred embodiment of the panel connector, receptacle connector and structural member is shown in detail. It will be observed in reference to the remaining FIGS. 16–20 that the panel connector, only a part of which is shown in FIG. 16 is equally adaptable for connection of wall panels and structural members, for the connection of wall panels and roof panels and for establishing a corner connection between wall panels and between wall and roof panels. The panel connector is shown generally at 85 and it includes at least one, and preferably a pair, of receptacle connectors, one being shown generally at 86. The panel connector also defines an intermediate flexible web 87 which may be disposed in the flat condition as shown in FIGS. 16 and 19 or in the curved condition shown at the right hand portion of FIG. 19 to form a corner connection between panels or the curved condition shown in FIG. 20 to form a connection between wall panels and roof panels either of the flat roof or hip roofed type. This same panel connector may also be used to establish connection between roof panels and to form the ridge of a hip roof. This panel connector may also find various other uses in the construction of buildings. It should also be born in mind that the flexible web 87 may be conformed, such as by a molding process, to the desired configuration thereof, i.e. flat as shown in FIG. 16 or curved as shown in FIGS. 19 and 20. In this case the flexible web would not be significantly yielded or flexed to form panel connections at the corners and roof structure of the building.

The receptacle connector 86 may conveniently take the form shown in FIG. 16 where diverging yieldable walls 88 and 89, which are also referred to as arms, cooperate to define an elongated channel or cavity 90 therebetween and define an elongated slot or opening 91 through which the spear-like connector 92 of a panel 93 is inserted. The wall structure 88 and 89 is also formed internally to define a pair of opposed undercut reverse angled internal hook like projections 94 and 95 intermediate the slot or chamber 90 and to define a pair of opposed undercut reverse angled internal hook-like projections 96 and 97 at the outer portion of the receptacle connector, which projections cooperate to define the elongate entrance opening 91 to the slot 90. By the term "reverse angled" it is meant that the bifurcated wall structure 8 and 89 are joined at the inner extremity of the slot 90 and extended toward the slot opening 91. The opposed pairs of internal ribs or projections project in reverse angled manner rearwardly generally toward the inner portion of slot 90. These internal ribs or projections are disposed in inclined relation to the longitudinal centerline of the slot 90 and thus are disposed in reverse angled relation to the direction of locking movement of the connector assembly so as to form internal hook-like elements.

It should also be noted that the spacing of the opposed inner projections is less than the spacing of the outer projections 96 and 97 so as to conform closely with the double barbed spear-like connector 92.

The spear-like connector 92, for the side portions of the panel 93, is preferably formed integral with the panel such as by an extrusion process. It should be born in mind that the spear-like connector may also be provided on the panels by any suitable means of attachment, for example such as shown in FIG. 18. The spear-like connector 92 defines an external configuration forming intermediate hook-like locking shoulders 98 and 99 that are disposed for interlocking engagement with the internal hook-like locking projections 94 and 95. Likewise, the spear-like connector 92 defines hook-like shoulder projections 100 and 101 about which the internal hook-like projections 96 and 97 are received.

These internal and external hook-like projections establish an interlocking relationship when the spear-like connector 92 is inserted fully into the slot or cavity 90. The first or inner barb of the spear-like connector which includes external projections 98 and 99 defines opposed rearwardly diverging substantially planar camming surfaces 102*a* and 103 that engage and spread the internal pairs of projections 94–95 and 96–97 during insertion of the connector 92 into the cavity 90. Likewise, the second or outer barb which forms rearwardly angled projections 100 and 101 defines opposed angulated tapered surfaces 102*a* and 103*b* which have camming relation with the opposed outer projections 96 and 97 which spread the arms as the undercut rearwardly angled hook-like shoulder projections 100 and 101 move past the oppositely angled hook-like projections 96 and 97 as the male spear-like connector 92 is fully seated into the cavity 90.

During assembly of the panel connection the first barb of the spear-like connector 92 is inserted into the first or entrance part of the receptacle connector 86 aligning the spear-like connector with the receptacle connector and holding them ready for the second and final part of the insertion movement which establishes the connection or joint. The first barb of the spear-like connector is more narrow than the second barb. During initial insertion movement, the tapered surfaces 102*a* and 103*b* engage the respective internal projections of the receptacle connector and cause it to flex to a more open condition by virtue of the flexible material from which it is composed. By having a tapered spear-like connector, the receptacle connector is caused to ride on the outer edges of the spear-like connector. Additionally, the tapered surfaces of the opposed barbs of the spear-like connector form a camming function to achieve appropriate spreading of the opposed arms that make up the receptacle connector. The opposed, gently tapered surfaces 102*a*, 103*a*, 1032*b* and 103*b* provide a camming function for spreading of the opposed arms of the receptacle connector to thus permit complete insertion of the spear-like connector into the cavity 90 with insertion force of relatively low magnitude. If the spear-like connector were not so tapered, the first connector jaws of the connector receptacle would be suspended beyond and not touching any part of the spear-like connector when the first barb comes into contact with the second or internal projections of the connector receptacle. This would remain the case until final positioning of the connectors has been made. In accordance with the present invention, the tapered spear-like connector allows the internal surfaces of the connector receptacle to ride on the outer edges of the spear-like connector at all times (continuously) until final positioning is accomplished. This tapering helps the connector receptacle to open by applying force along a greater internal surface area of the inner part of the connector receptacle as the spear-like connector is inserted into the cavity 90.

The spear-like connector must be of less length than the cavity 90 of the connector receptacle because the connector receptacle is made to curve around the reverse angled rear surfaces of the opposed barbs of the spear-like connector. The spear-like connector must pass the final seating position inside the connector receptacle in order to pass the curved ends of the receptacle connector. A gasket or resistive material is placed at the inner end of the connector receptacle cavity in order to act as a spring to force the barbs of the spear-like connector into fully seated conformance with the reverse angled hook-like internal projections of the connector receptacle. This gasket also functions as a moisture protector.

It is the resistance of the "reflex angle" that gives this connector assembly great superiority over a connector that shows opposed planes only perpendicular to the insertion line of the spear-like connector. The term "reflex angle" as it applies to the present invention is an angle that when in relation to a perpendicular reference is less than 90° to the perpendicular reference. The angle is also formed so as to be less than 90° to the perpendicular reference with respect to a resisting force that would act to disengage a spear-like connector from a cavity formed by a connector receptacle when the two are fully engaged. The reflex angle action of the inner surfaces of the connector cause the external barbs of the spear-like connector to force into the undercut pockets of the connector receptacle when a force is created to cause the connector parts to separate. Because of this socketing effect, the greater the force to separate the spear-like connector from the connector receptacle, the greater the positioning and force occurs to hold the connectors from separating. Accordingly, the connector assembly of the present invention is much superior to a connector system where opposed surfaces are not in a reflex position to the insertion line of the connector projection but are only perpendicular to the insertion line of the connector projection. When a separating force is created on parallel surfaces in a perpendicular relation to the insertion line, the ends of the parallel surfaces of both male and female components of the connector assembly will bend, causing the male part to slide away from its seating position with the female component. This sliding effect does not occur with a connector having reflex angles to the perpendicular. The connector assemblies illustrated and described in connection with FIG. 16 thus is designed in a manner that allows easy assembly of the connector components by application of minimal force. Once assembled, however, it becomes virtually impossible to forcibly pull the connector assembly apart. The interengaging reverse or reflex angled hook-like projections formed externally of the spear-like connector and internally of the receptacle connector establish a unique interengaging relation when in fully seated assembly that effectively resists forcible separation of the connector assembly. Accordingly, in the event separation of the connector and assembly is required, it will typically be necessary to apply one or more tools to the connector structure that functions to spread the opposed arms of the receptacle connector to thus release the hook-like interengagement of the reflex angled components. The opposed arms of the receptacle connector are sufficiently flexible that connection releasing activity of this nature can be accomplished through the use of tools.

The spear-like connector 92 also incorporates an elongated nose portion 102 forming a rounded extremity 103 which is spaced from the curved bottom wall 104 of the cavity when the connector 92 is fully inserted into the cavity as shown in FIG. 16. This space or standoff will permit a sealing member to be positioned at the bottom of the cavity 90, which sealing member will be engaged by the rounded nose portion of the spear-like connector for establishment of a positive seal between the spear-like connector and the internal surfaces of the panel connector.

Adjacent the inner extremity of the receptacle connectors, the panel connector 85 defines a pair of elongated integral flanges 105 which extend toward the flexible wall 87 and which define an elongate receptacle 106 which is adapted to receive the interlocking flange portion 101 of an elongate structural member 108. The structural member 108, while being shown in FIG. 19 as of generally rectangular form, may be of triangular, octagonal or any other suitable configuration or dimension to provide the building with appropriate structural integrity. Since the structural member 108 is disposed in releasable connection with the panel connector 85, any suitable structural member having an interfitting wall and connection flange such as that shown at 107–109 in FIGS. 16 may be assembled to the panel connector in the manner shown. This feature will minimize the number of component parts that are necessary for assembly of a building structure. The panel connector is enabled to provide a number of connecting and supporting functions which minimizes the total number of component parts that need be maintained in inventory in order to meet the needs of users.

Referring now to FIG. 17, the panel 93 is shown to be provided with opposed side connectors 92 that are preferably molded integral with the panel structure such as by means of an extrusion process. The panel 93 also includes top and bottom connectors 110 and 111 which are assembled to the panel after the panel has been formed. These top and bottom connectors are of substantially identical configuration as shown in greater detail in the vertical section of FIG. 18. The panel connectors 110 and 111 will each form a spear-like connector 112 having a substantially identical configuration with the spear-like connector 92 shown in FIG. 16. The top and bottom connectors also define a transverse flange 113 having the spear-like connector 112 extending from the central portion thereof. A pair of flanges 114 and 115 extend from respective sides of the flange 113 and are disposed in normal relation with the flange 113 and in parallel relation with one another. The spacing of the flanges 114 and 115 is such that they are received in intimate engagement with the receptacle defined by internal surfaces of opposed walls 116 and 117 and are bonded solvent welded or otherwise secured to the walls 116 and 117 so as to become integral with the panel structure.

The bottom connector 111 will be receivable within the cavity or slot of a receptacle connector 118 which extends upwardly from a base plate 119 and may, if desired, be formed integrally with the base plate 119 such as by an extrusion operation. The base plate may then be secured to a foundation 120 by bolts 121 or by any other suitable means of structural interconnection At the upper portion as shown in FIG. 18 the top connector 110 is positioned to be received by the cavity 90 of the receptacle connector 86 of a panel connector 85 in the same manner as shown in FIG. 16. In fact the same type of connector shown in FIG. 16 may be employed and the flexible web 87 thereof may be formed to a desired curvature for connection of the opposite receptacle connector to the spear-like connector of a horizontal or inclined roof panel such as in the manner shown in FIG. 20.

In FIG. 19 a wall panel 93 is shown with its spear-like connector 92 being received by the receptacle connector 86 of the panel connector 85. The opposite receptacle connector receives the spear-like connector 92 of a hinge structure 122 which provides support for a door 123. Thus, the panel connectors will effectively provide for simple and efficient assembly of various building structures to form a building such as shown in FIG. 1 or to form any other suitable type of building structure. It is not necessary, therefore, to provide structural connectors such as bolts for retention of parts of the building structure in assembly. The present invention permits the assembly of a building structure in simple and efficient manner through the use of the snap fitting connectors which are shown.

In FIG. 20 a hip roof type building structure is shown wherein wall panels are provided as shown in 93 and roof panels are provided as shown at 124, which roof panels may have a construction identical to that of the wall panels. The roof and wall panels are capable of being assembled by means of top connectors as shown in 85 and bottom connectors as shown at 118 and 119. The same type of connector may be utilized to join the roof panels 124 and 125 in assembly.

While the foregoing is directed to the preferred embodiments of the present invention, other and further embodiments of the invention may be devised without departing from the basic scope thereof, and the scope thereof is determined by the claims which follow.

What is claimed is:

1. Panel and panel connector assemblies for building structures and the like, comprising:

(a) panel means defining opposed side edges and opposed top and bottom edges;

(b) elongated panel connector means composed of flexible material and extending from respective ones of said side edges and having a spear-like cross-sectional configuration forming inner and outer longitudinally spaced pairs of rearwardly angled hook-like locking projections each pair defining opposed tapered outer cam surfaces and undercut rearwardly angled shoulder projections forming opposed locking recesses each having an undercut rearwardly angled back shoulder surface said inner pair of locking projections having a lesser width as compared to the width of said outer pair of locking projections; and (c) elongated receptacle connector means for joining said panel members and forming inner and outer longitudinally spaced pairs of locking cavities therein substantially conforming to said spear-like cross-sectional configuration of said panel connector means, each of said pairs of locking cavities being defined by internal undercut angled locking shoulder disposed for intimate locking engagement with respective ones of said rearwardly angled back shoulders of said elongated panel connector means of said panel means upon locking assembly of said elongated panel connector means within said locking cavity, said undercut locking shoulders of said elongated panel connector means and said elongated receptacle connector means cooperatively defining reflex angle interengagement for resisting forces tending to separate said panel connector means from said panel receptacle means.

2. Panel and panel connector assemblies for building structures and the like as recited in claim 1, wherein said elongated panel connector means forms a structural member to enhance the structural integrity of connected panel means and panel connector means.

3. Panel and panel connector assemblies for building structures and the like as recited in claim 1, wherein:

(a) said panel connector means defines structural connector means; and (b) an elongated structural member is releasably receivable in interlocking engagement with said panel connector means.

4. Panel and panel connector assemblies for building structures and the like as recited in claim 3, wherein:

(a) a pair of looking members extend from said panel connector means; and (b) said elongated structural member is of a configuration for establishing releasable locking interconnection with said locking members.

5. Panel and panel connector assemblies for building structures and the like as recited in claim 1 wherein said elongated panel connector means forms a pair of said elongated receptacle connectors and a web integral therewith and disposed intermediate thereof said web being of desired configuration to selectively establish straight and angulated connections between adjacent panels thereby permitting said adjacent panels to be selectively disposed in coplanar relation and angulated relation.

6. Panel and panel connector assemblies for building structures and the like as recited in claim 5, wherein said web is sufficiently flexible to permit said adjacent panels to be disposed in angulated relation from 0° to greater than 90°.

7. Panel and panel connector assemblies for building structures and the like as recited in claim 1, wherein elongated top and bottom connector means extend from said top and bottom edges of said panel means and form at least one back shoulder that is receivable in interlocking relation within said elongated receptacle connectors.

8. Panel and panel connector assemblies for building structures and the like as recited in claim 7, wherein:

(a) said panel means defines wall structures forming top and bottom receptacles;

(b) said top and bottom connector means each form connector portions that are receivable in intimate engagement within respective ones of said top and bottom receptacles; and (c) means retaining said top and bottom connector means in fixed assembly respectively within said top and bottom receptacles.

9. Panel and panel connector assemblies for building structures and the like as recited in claim 8, wherein an elongated base plate is provided having a flange portion that is adapted to be fixed to a foundation said elongated base plate defining an elongated upstanding bottom panel connector forming an internal cavity and defining at least one internal locking shoulder adapted to receive said bottom connector means of said panel means in interlocking relation therein.

10. Panel and panel connector assemblies for building structures and the like as recited in claim 1, wherein said elongated side connector means is formed integrally with said panel means.

11. Panel and panel connector assemblies for building structures and the like as recited in claim 1, wherein:

(a) said elongated side connector means defines a spear-like configuration having at least one pair of opposed back shoulders thereon; and (b) said elongated receptacle connector defines at least one pair of opposed internal locking shoulders disposed for locking engagement with said opposed back shoulders when said side connector means is fully inserted into said cavity.

12. Panel and panel connector assemblies for building structures and the like as recited in claim 1, wherein said elongated receptacle connector means is composed of a material that is sufficiently flexible to permit tool assisted disassembly of said locking engagement of said back shoulders and locking shoulders to thereby permit separation of said panel means from said elongated panel connector means.

13. The panel and panel connector assemblies of claim 1, wherein:

(a) said elongated panel connector means defines an elongate centrally oriented nose portion of less width as compared to the width of said inner pair of rearwardly angled hook-like locking projections; and (b) said elongated receptacle connector means defines an inner receptacle portion of a configuration for receiving said elongate centrally oriented nose portion in intimate engagement therein.

14. The panel and panel connector assemblies of claim 13, wherein:

said centrally oriented nose portion being of less longitudinal length as compared to said inner receptacle portion of said elongated receptacle connector means and, upon assembly, defining a seal space for receiving a sealing member.

15. Panel and panel connector assemblies for building structures and the like, comprising:

(a) panel means defining opposed side edges and opposed top and bottom edges;

(b) elongated panel connector means composed of flexible material and extending from respective ones of said side edges and having inner and outer longitudinally spaced rearwardly angled hook-like locking projections each defining opposed tapered outer cam surfaces and undercut rearwardly angled shoulder projections forming opposed locking recesses each having an undercut rearwardly angled back shoulder surface, said inner locking projection, having a lesser width as compared to the width of said outer locking projection; and (c) elongated receptacle connector means for joining said panel means and forming inner and outer longitudinally spaced locking cavities therein substantially conforming to the configuration of said elongated panel connector means, each of said longitudinally spaced locking cavities defining internal undercut angled locking shoulders disposed for intimate locking engagement with respective ones of said rearwardly angled back shoulders of said elongated panel connector means of said panel means upon locking assembly of said elongated panel connector means within said locking cavity, said undercut locking shoulders of said elongated panel connector means and said elongated receptacle means cooperatively defining reflex angle interengagement for resisting forces tending to separate said panel connector means from said panel receptacle means.

16. The panel and panel connector assemblies of claim 15, wherein:

(a) said elongated panel connector means defines an elongate centrally oriented nose portion of less width as compared to the width of said inner pair of rearwardly angled hook-like locking projections; and (b) said elongated receptacle connector means defines an inner receptacle portion of a configuration for receiving said elongate centrally oriented nose portion in intimate engagement therein.

17. The panel and panel connector assemblies of claim 16, wherein:

said centrally oriented nose portion being of less longitudinal length as compared to said inner receptacle portion of said elongated receptacle connector means and, upon assembly, defining a seal space for receiving a sealing member.

18. The panel and panel connector assemblies for building structures and the like as recited in claim 15, wherein said elongated panel connector means forms a structural member to enhance the structural integrity of connected panel means and panel connector means.

19. The panel and panel connector assemblies for building structures and the like as recited in claim 15, wherein:

(a) said panel connector means defines structural releasably receivable in interlocking engagement with said panel connector means.

20. The panel and panel connector assemblies for building structures and the like as recited in claim 19, wherein:

(a) a pair of locking members extend from said panel connector means; and (b) said elongated structural member is of a configuration for establishing releasable locking interconnection with said locking members.

21. Panel and panel connector assemblies for building structures and the like as recited in claim 15 wherein said elongated panel connector means forms a pair of said elongated receptacle connectors and a web integral therewith and disposed intermediate thereof said web being of desired configuration to selectively establish straight and angulated connections between adjacent panels thereby permitting said adjacent panels to be selectively disposed in coplanar relation and angulated relation.

22. Panel and panel connector assemblies for building structures and the like as recited in claim 21, wherein said web is sufficiently flexible to permit said adjacent panels to be disposed in angulated relation from 0° to greater than 90°.

23. Panel and panel connector assemblies for building structures and the like as recited in claim 15, wherein elongated top and bottom connector means extend from said top and bottom edges of said panel means and form at least one back shoulder that is receivable in interlocking relation within said elongated receptacle connectors.

24. Panel and panel connector assemblies for building structures and the like as recited in claim 23, wherein:

(a) said panel means defines wall structures forming top and bottom receptacles;

(b) said top and bottom connector means each form connector portions that are receivable in intimate engagement within respective ones of said top and bottom receptacles; and (c) means retaining said top and bottom connector means in fixed assembly respectively within said top and bottom receptacles.

25. Panel and panel connector assemblies for building structures and the like as recited in claim 24, wherein an elongated base plate is provided having a flange portion that is adapted to be fixed to a foundation, said elongated base plate defining an elongated upstanding bottom panel connector forming an internal cavity and defining at least one internal locking shoulder adapted to receive said bottom connector means of said panel means in interlocking relation therein.

26. Panel and panel connector assemblies for building structures and the like as recited in claim 15, wherein said elongated side connector means is formed integrally with said panel means.

27. Panel and panel connector assemblies for building structures and the like as recited in claim 15, wherein:

(a) said elongated side connector means defines a spear-like configuration having at least one pair of opposed back shoulders thereon; and (b) said elongated receptacle connector defines at least one pair of opposed internal locking shoulders disposed for locking engagement with said opposed back shoulders when said side connector means is fully inserted into said cavity.

* * * * *